United States Patent [19]

Asahi et al.

[11] 4,394,234

[45] Jul. 19, 1983

[54] METHOD OF PROCESSING ELECTRICALLY CONDUCTIVE MATERIAL BY GLOW DISCHARGE

[75] Inventors: Naotatsu Asahi, Katsuta; Sizuka Yamaguchi, Hitachi; Katsuyoshi Terakado, Katsuta, all of Japan

[73] Assignee: Hitachi, Ltd., Tokyo, Japan

[21] Appl. No.: 174,748

[22] Filed: Aug. 4, 1980

[30] Foreign Application Priority Data

| | | | |
|---|---|---|---|
| Feb. 2, 1979 | [JP] | Japan | 54-10472 |
| Sep. 14, 1979 | [JP] | Japan | 54-117298 |
| Jan. 23, 1980 | [JP] | Japan | 55-5790 |

[51] Int. Cl.[3] ..... C01B 21/30; C21D 1/48

[52] U.S. Cl. ..... 204/164; 148/16.5; 148/16.6; 204/177

[58] Field of Search ..... 204/164, 177; 148/16.5, 148/16.6

[56] References Cited

U.S. PATENT DOCUMENTS

| | | | |
|---|---|---|---|
| 2,916,409 | 12/1959 | Bucek | 148/16.6 X |
| 3,228,809 | 1/1966 | Berghaus et al. | 148/16.6 X |
| 3,536,602 | 10/1970 | Jones et al. | 204/164 |
| 3,616,383 | 10/1971 | Kausler | 204/177 |
| 3,728,051 | 4/1973 | Humbert | 418/178 |
| 3,730,863 | 5/1973 | Keller | 204/164 |
| 3,925,116 | 12/1975 | Engel | 148/143 |
| 4,108,693 | 8/1978 | L'Hermite et al. | 148/16.5 |
| 4,152,177 | 5/1979 | Mantel et al. | 148/16.5 |
| 4,194,930 | 3/1980 | Tanaka et al. | 148/16.6 |

FOREIGN PATENT DOCUMENTS

| | | |
|---|---|---|
| 1223655 | 8/1966 | Fed. Rep. of Germany . |
| 1621268 | 6/1971 | Fed. Rep. of Germany . |
| 785878 | 11/1957 | United Kingdom . |
| 1349290 | 4/1974 | United Kingdom . |

OTHER PUBLICATIONS

Hauch, F. Prakt. Metallbearb. vol. 63, No. 9, pp. 489–494 (1969).

Edenhofer, Härterei-Technische Mitteilungen, vol. 29, Part 2, pp. 105–112, pub. by Klocknertonen GmbH, Cologne (1974).

*Primary Examiner*—F. Edmundson

*Attorney, Agent, or Firm*—Antonelli, Terry & Wands

[57] ABSTRACT

A glow discharge surface treatment process wherein only the selected portions of a workpiece adjacent to or surrounded by the associated secondary electrodes are surface-treated so as to provide different treatments on the workpiece according to the position of the secondary electrodes. The each secondary electrode is provided close to at least a portion of the workpiece, and the workpiece and the associated secondary electrode are both connected to the cathode. When a voltage is applied between the cathode and the wall of the container in the treatment apparatus which forms the anode, mutual interference effect (which is referred to as a hollow cathode effect) of negative glow discharges is established between the workpiece and the associated secondary electrode so as to accelerate the heat treatment for the selected portion of the workpiece surrounded by the secondary electrode. The gas pressure in the container is varied to control the hollow cathode effect. In the treatment process of the present invention, the workpiece is thermally treated so as to provide differently treated portions therein.

20 Claims, 24 Drawing Figures

METHOD OF PROCESSING ELECTRICALLY CONDUCTIVE MATERIAL BY GLOW DISCHARGE

This invention relates to a method of processing a material having an electrically conductive surface through a glow discharge treatment. More specifically, this invention relates to improvements in a method of surface treatment of a workpiece through a glow discharge in a reduced-pressure or vacuum atmosphere, to provide a heat treatment of an electro-conductive surface of the workpiece, for example a metallic material.

An increasing interest has been directed to an ion surface treatment using a glow discharge which is established at a high temperature in a gas atmosphere entrained particularly with a diffusion substance to cause the surface of metalic material such as iron or steel to be hardened. A typical example of a process for the ion surface treatment is a treatment with ionized nitrogen wherein a reduced gas atmosphere containing nitrogen gas is used to harden the workpiece. In the process, a workpiece to be processed is placed in a container in which the pressure is kept at $10^{-1}$ Torr or below. Since, the surface treatment process using a glow discharge is well known in the art, detailed discussion about the surface treatment are omitted for the sake of simplicity.

Ionized nitrogen atoms diffuse into the workpiece to harden the surface thereof. According to the method, workpieces of the same configurations will have a substantially same treatment temperature all over the workpieces, because the glow discharge plasma envelops the workpieces. When it is required, in some applications, to provide hardening treatment to only a desired part of the surface of the workpiece rather than the entire surface thereof to obtain local hardening of the workpiece while keeping the other surface portion unchanged, it is a common practice to apply a coating for preventing nitriding (non hardening) treatment to the desired portion so that only the desired portion is subjected to a glow discharge. In the above mentioned method, however, the entire workpiece will be heated to substantially the same temperature as is a covered portion. This means that more energy is wasted especially when a larger workpiece is partially to be treated, because the workpiece is wholly heated during the treatment.

As a method of obtaining locally differently treated layers on a workpiece by ion-treating (for example, different depths and hardness), there is disclosed an ion surface-treatment process in the Japanese Patent Application Laid-Open No. 6956-1972 wherein an additional metal electrode (which forms an anode with respect to the workpiece) is inserted between the workpiece (cathode) and the wall of the vacumm container (anode) and is connected through a potentiometer to the positive terminal of the dc power supply so that changing the potential of the metal electrode by means of the potentiometer will partially vary the ion collision energy. With the process of e.g. ion nitriding, the additional metal electrode is provided in the vicinity of the desired portion of a workpiece which is to have a different nitriding layer, so that a change in potential of the metal electrode by means of the external circuit will provide a change in the ion collision energy at the desired portion to control the amount of nitrogen atoms that tend to diffuse into the portion, thereby forming a partially different nitrided layer. Since the nitrogen diffusion depends greatly on temperature not on the ion collision energy in the case of such a method of changing the ion collision energy, it is greatly difficult to change the depth of the nitrided layer partially.

Accordingly, it is an object of the present invention to provide a glow-discharge surface treatment which is capable of providing heat treatment on the desired surface of a workpiece or article to be treated, with less heating energy.

It is another object of the present invention to provide a glow-discharge surface treatment which allows partical treatment of the surface of a workpiece, with reduced heating energy.

It is a further object of the present invention to provide a glow-discharge surface treatment which allows plural different kinds of treatments to be applied to a workpiece in a single container.

It is yet another object of the present invention to provide a glow-discharge surface treatment in which a workpiece is heat treated by changing the pressure of atmosphere in the treatment container.

It is yet a further object of the present invention to provide a glow-discharge surface treatment in which the treatment temperature of a workpiece is accurately controlled.

According to the present invention, there is provided a surface treatment process wherein glow discharge is established between the cathode and anode to carry out heat treatment of a workpiece under a reduced pressure condition, comprising the steps of placing the workpiece which has a conductive surface and is connected to the cathode, and a secondary electrode which has a conductive surface and is connected to the cathode, and effecting a glow discharge between the conductive surface of said workpiece and the secondary electrode and the anode.

The workpiece and the secondary electrode are placed in such a manner that glow-lighting or luminescence is confined therebetween and hence the treatment effect is accelerated by the combined luminescence.

In the principle of the glow-discharge process according to the present invention, the amount of atoms to be diffused into the workpiece and the diffusion depth below the workpiece surface must be accurately controlled in order to provide a suitable hardness and smoothness for the surface of the workpiece without adverse effect on the workpiece material itself. If the surface concentration is kept constant, the treatment temperature will play an important role. Now, considering an example in which steel material is used as its workpiece to be treated and nitrogen is employed as its surface hardening atom, the treatment temperature must be in the range of 400°–700° C. In the carburizing surface-treatment, the treatment temperature must be in the range of 700°–1100° C. When boron is used as the diffusion element, the treatment temperature must be in the range of 800°–1200° C. Further, sulfur is employed as its diffusion atom, the treatment temperature must be 150°–600° C. In this way, its suitable treatment temperature will be different depending on the diffusion atom and workpiece material to be used. For this reason, it will be appreciated that appropriate temperature control for particular portion of the surface of workpiece permits local change of the workpiece surface property. Since the treatment temperature is dependent on the state of the glow discharge, selected local treatment on the workpiece can be obtained by controlling the glow discharge on that portion.

In accordance with the present invention, irregular temperature distribution on the workpiece surface can be accomplished by positioning a secondary electrode (which has much the same potential as the workpiece) so that the secondary electrode is spaced a selected distance from the desired treatment surface of the workpiece, whereby a combined luminescence of glow discharge is formed between the secondary electrode and the facing workpiece surface, increasing the surface temperature of the facing workpiece. This principle of controlling the temperature is based on the fact that mutual interference effect between the secondary electrode and workpiece, or the combined glow discharge will cause increase of the current density therebetween. The inventors of the present invention call the mutual interference effect a hollow-cathode effect which is found in a hollow cathode of a hollow cathode tube for use in an atomic absorption analyzer. At that portion of the workpiece which faces the secondary electrode, the ionization concentration of the gas will increase and active diffusion atoms will correspondingly act on the workpiece surface.

In order to obtain an optimized mutual interference effect, it is important to control the distance between the workpiece surface and the secondary electrode. The distance between the workpiece surface and the secondary electrode, varies the area of negative glows on the workpiece and the associated secondary electrode. The length of the negative glow differs according to the gas composition and the gas pressure and the mutual interference effect depends mainly on the length of the glow. The negative glow discharge is closely associated with the length. In an usual ion surface-hardening process, when the distance between the workpiece surface and the secondary electrode is in the range of 0–0.5 mm, gas reaction with the workpiece tends to be blocked; whereas if the distance is above 50 mm, the interference between glow discharges becomes weaker, reducing the heating effect of radiation heat from the secondary electrode to the workpiece, with an increased thermal loss of the secondary electrode. For these reasons, the distance is preferable in the range of 2–25 mm.

On the other hand, as the secondary electrode, any conductive material may be used as long as it does not provide adverse effect on the surface reaction of the workpiece. As regards the size of the secondary electrode, it is preferable that the surface area of the secondary electrode is substantially equal to or greater than the selected surface area of the workpiece. However, it will be understood that any secondary electrode may be employed that is provided with a conductive face and the area of that is substantially equal to or greater than the selected surface area of the workpiece.

The hollow cathode effect according to the present invention is dependent on the gas pressure in the container. When the distance between the secondary electrode and the workpiece is fixed and the gas pressure is variable, the temperature of the workpiece close to the secondary electrode will vary depending on the gas pressure because of the hollow cathode effect. In this case, the temperature on the workpiece not close to the secondary electrode can be left unchanged even if the gas pressure changes. The temperature difference between the portions on the workpiece will also depend on the gas composition and the secondary electrode configuration. If the gas pressure is out of the selected range, then the entire workpiece has an identical temperature without irregular temperature distribution, because the hollow cathode effect does not occur. Therefore, the surface treatment for the one or more portions of a workpiece can be selectively accomplished by providing the hollow cathode effect during the treatment time or by providing it only during the selected period of the treatment time, so that only a selected surface portion can be treated or the workpiece having a plurality of surfaces giving different functions can be obtained. The gas pressure which depends on the gas composition, is preferably in the range of 0.1–10 Torr, more particularly 1.0–7.0 Torr.

These and other objects, features and advantages of the present invention will be readily apparent from the following descriptions taken in conjunction with the accompanying drawings in which.

Figure 1:
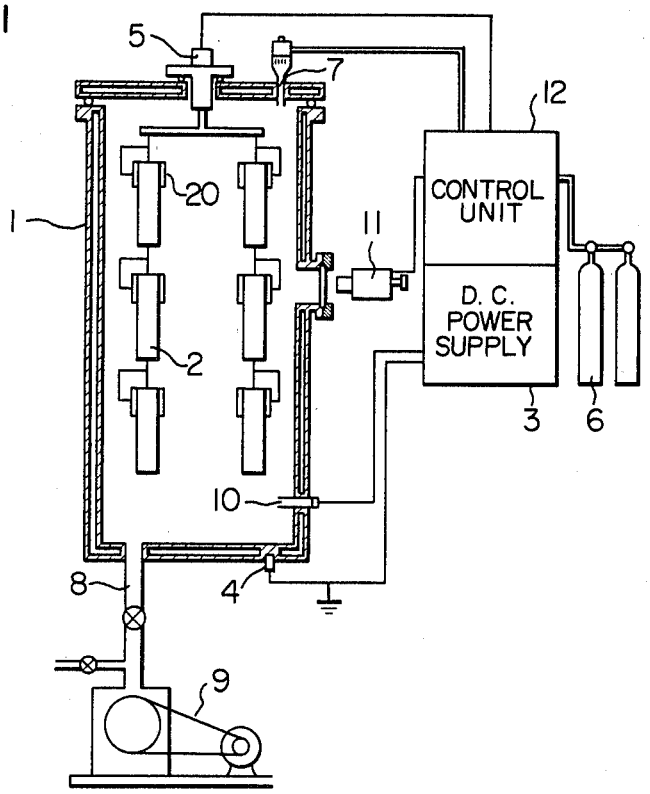
FIG. 1 is a schematic diagram of an embodiment of a surface treatment apparatus carried out in accordance with a surface treatment process of the present invention.

While the present invention will now be described with reference to the preferred embodiments shown in the drawings, it should be understood that the invention is not limited to those embodiments but includes all other possible modifications, alternations and equivalent arrangements within the scope of appended claims.

EMBODIMENT 1

Turning now to the drawings, there is shown in FIG. 1 a surface treatment apparatus carried out according to a surface treatment process of the present invention, the apparatus consists of a reduced pressure or vacuum furnace container 1, workpieces or articles 2 to be treated, a dc power supply 3, an anode terminal 4, a cathode terminal 5, a bomb 6 for atmosphere gas or treatment gas, a gas inlet port 7, a gas exhaust port 8, a vacuum pump system 9 for reducing the pressure in the container 1, a terminal 10 leading to a vacuum gauge that detects the pressure in the container 1, an optical pyrometer 11 for measuring the temperature on the surface of the workpiece, and a control unit 12 for controlling glow discharge over the workpieces. The vacuum container 1 itself is electrically connected to the anode terminal 4, and the wall of the container 1 is cooled with water to avoid the heating of devices and parts around the container 1 by radiation heat of glow discharge.

Figure 2:
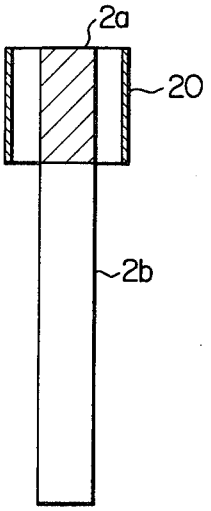
FIG. 2 is an enlarged veiw of the secondary electrode and the metallic material to be treated, which is used in the surface treatment apparatus in FIG. 1.

Explanation will be made in FIG. 1 in the case that the surface treatment process of the present invention is embodied as an ion carburizing apparatus in which workpieces to be treated are carburized in glow discharge plasma. In FIG. 2, only the portion 2*a* of the workpiece 2 is covered with the secondary electrode to cause the hollow cathode effect on the portion 2*a* for carburizing.

As the workpiece 2, in this embodiment, a shaft (14 mm in diameter, and 100 mm in length) of SCM451 chromium-molybdenum steel (C 0.13–0.18%, Si 0.15–0.35%, Mn 0.6–0.85%, P 0.03% or less, S 0.03% or less, Cr 0.9–1.1%, Mo 0.15–0.30%) conforming to the Japanese Industrial Standard (JIS) was used. As shown in FIG. 2, the shaft or workpiece has the portion (upper) 2*a* necessary to carburize of about 25 mm long and the portion 2*b* (lower) unnecessary to carburize of about 75 mm long. In this connection, the secondary electrode 20 comprised a conductive carbon (non-metal material) cylinder of 26 mm in the inner diameter, 30 mm in the length and 1.5 mm in the wall thickness. The electrode 20 was spaced 6 mm from the surface of the workpiece 2.

Figure 3:
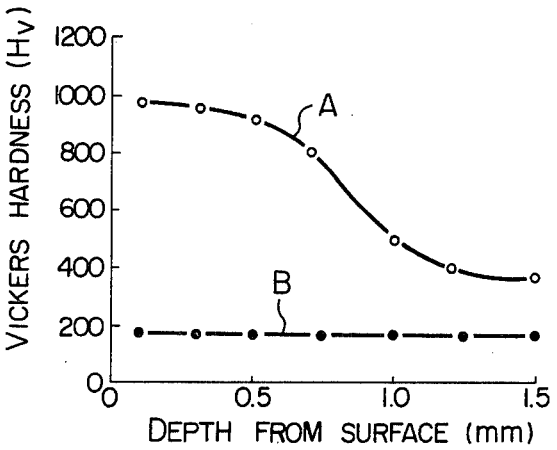
FIG. 3 is a graphical representation showing the results in the case that the surface treatment process is applied as an ion carburizing process, which shows the relationship between Vickers hardness and depth below the surface of the workpiece to be treated.

In the carburizing process, first, the pressure in the vacuum container 1 was reduced to $10^{-2}$ Torr, and then hydrogen and methane gas were introduced into the container, in which case, the pressure in the container was kept at 3 Torr. A dc voltage between 400–1000 V was applied so that glow discharge occurs and only the portion 2*a* of the workpiece is heated to 850° C. for 30 minutes. Then, the workpiece 2 was quenched or hardened and checked about its hardness. The results are given in FIG. 3 in which curve A indicates the hardness distribution of the portion 2*a* (treatment portion) of the workpiece 2 according to the process of the present invention and curve B indicates that of the portion 2*b* (non-treatment portion). It will be found from FIG. 3 that the portion 2*a* heated and hardened according to the method of the present invention has a hardened layer extending up to about 1 mm below the surface of the workpiece, the hardness of the hardened layer is above Hv 513 (Vickers hardness). This is because since carbon atoms are diffused into the surface of the workpiece to form a carbon layer of different depth concentration, the hardness varies depending on its depth below the surface. On the other hand, for curve B of the non-treatment portion 2*b*, the hardness does not vary with the depth below the surface of the workpiece and is a constant value of Hv 160 (Vickers hardness). The hardness of Hv 160 is the same as that of the spherodized SCM21 steel. This results in the fact that carburizing treatment is provided on the local treatment portion 2*a* and is not provided on the non-treatment portion 2*b*, according to the present invention. The test showed, further, that the power consumption required for the process of the present invention is about half that when the entire workpiece is treated at its treatment temperature, allowing the remarkable reduction of the heating energy.

EMBODIMENT 2

A shaft (100 mm in diameter and 2000 mm in length) of SCM4 chromium-molybdenum steel (JIS) (corresponding to AISI 4140) as a workpiece sample was nitrided in glow discharge plasma within a surface nitriding apparatus similar to embodiment 1. It is assumed in this test that the shaft must be nitrided only at its both ends and only at the central portion of 1000 mm width because the portions to be nitrided will contact with bearings and thus requires a higher abrasion resistance, whereas the other portions must not be nitrided because of its easy machining. Secondary electrodes are placed around the portions of the shaft to be nitrided, 6 mm apart from the surface thereof. In this connection, each secondary electrode is of a cylinder (120 mm in height and 112 mm in inner diameter) shaped from a 10 mm-thick SPCC cold-rolled steel plate (JIS).

In the nitriding process, first, the pressure in the vacuum container 1 was decreased to $10^{-2}$ Torr, and then hydrogen and nitrogen gas were fed into the container 1 so as to maintain the container pressure at 3 Torr. A dc voltage between 400–1000 V was supplied so that glow discharge takes place and only the portions to be nitrided of the shaft is heated to 550° C. for 20 hours.

Figure 4:
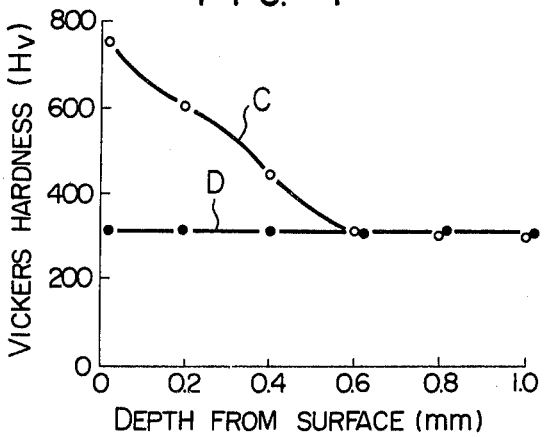
FIG. 4 is a graphical representation showing the results in the case that the surface treatment process is applied as an ion nitriding process, which shows the relationship between Vickers hardness and depth below the surface of the workpiece to be treated.

The hardness of the obtained shaft is shown in FIG. 4 in which curve C indicates the hardness of the nitrized portions and curve D indicates that of the other portion, that is, non-nitrized portions. It will be easily found from FIG. 4 that the hardness of the nitrized portions varies from the surface thereof (Hv 750) to the depth 0.6 mm below the surface; while the other portions, that is, the non-nitrized portions has a constant hardness of Hv 320 that is a value after the SCM4 steel shaft was tempered and thus the non-nitrized portions were not nitrized. Therefore, it was possible to machine the non-nitrized portions easily after the processing. In this way, according to the process of the present invention, the selected portions alone of the workpiece can be nitrized without providing any nitrizing treatment on the other of the workpiece.

EMBODIMENT 3

Figure 5:
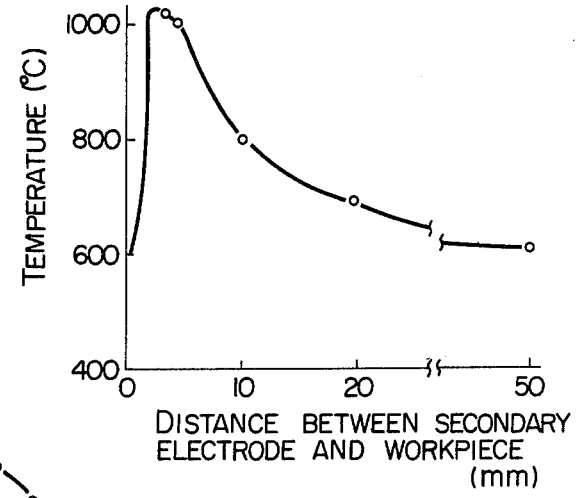
FIG. 5 is a graphical representation showing an example of a relationship between the distance from the surface of the workpiece to the secondary electrode and the temperature on the workpiece surface under the influence of the hollow cathode effect.

The present invention will be next explained in conjunction with an embodiment of a surface treatment process in which surface treatment is carried out under the control of the gas pressure in the container. As has been described earlier, the hollow cathode effect depends on the distance between the secondary electrode and the associated workpiece and on the gas pressure in the container. The relationship between the distance and the temperature resulting from the hollow cathode effect will depend greatly upon the composition of the gas introduced into the container, the gas pressure, the configurations of workpieces to be processed, and the material and configurations of the secondary electrodes. FIG. 5 shows an example where the gas pressure is fixed. In the same figure, the selected portion of the workpiece surrounded by the associated secondary electrode is heated at 600° C. when the distance between the workpiece and the secondary electrode is in the range of 0–0.5 mm, and thus has substantially the same temperature as that for the other glow faces of the workpiece. As the distance increases from 0.5 mm, the temperature on the portion surrounded by the secondary electrode abruptly increases. When the distance is in the range of 2–5 mm, the portion surrounded by the secondary electrode has a peak temperature. With the distance between 2–5 mm, the temperature on that portion of the workpiece which is surrounded by and is directly below the secondary electrode reaches above about 1000° C. and is about 400° C. higher than that on the other glow discharge faces thereof. When the distance further increases, the temperature difference between that portion of the workpiece and the other glow faces thereof reduces gradually. If the distance becomes about 50 mm, the temperature of that portion is substantially the same as that of the other glow discharge faces.

Next, consideration will be directed to the gas pressure. The gas pressure must have a suitable value, depending on the mixture ratio of the gas and the property of the workpiece to be treated. For example, in the case that only the selected portion of a workpiece must be mainly carburized in a deeper or heavier extent on the basis of a typical carbonitriding process, the relationship between the temperature of the heavily carburizing portion of the workpiece and the gas pressure is shown as FIG. 6 in which 6*a* shows temperature raised by the hollow cathode effect and 6*b* shows temperature in the case with no hollow cathode effect. In this example, a shaft of 25 mm in diameter and 250 mm in length is used as the workpiece and heavily carburizing treatment must be applied to that portions of the workpiece the width of which is 40 mm from the ends thereof because the portions are to engage with ball bearings. The other portion other than the heavily carburizing portion of the shaft is provided with usually, i.e., normal depth of carbonitriding or nitriding treatment which is intended to improve fatigue strength. In this connection, each cylindrical secondary electrode (31 mm in diameter, 40 mm in length and 4 mm in wall thickness) surrounds the each heavily carburizing portion of the shaft. The temperature of the portion of the shaft over than the heavily carburizing portion is kept at 600° C., and the gas is a mixture of hydrogen, argon and methane gas. If the gas pressure is kept below 0.5 Torr during the processing, the portion surrounded by the secondary electrode has much the same temperature as the other of the shaft. When the gas pressure is kept higher than 0.5 Torr, the portion of the workpiece surrounded by the secondary electrode has a higher current density of glow discharge than the other thereof, resulting in the fact that the portion surrounded by the secondary electrode is heated higher than the other thereof. In this case, if the gas pressure is kept at about 320° C., for example, the temperature of the portion surrounded by the secondary electrode becomes about 320° C. higher than that of the other.

Figure 7:
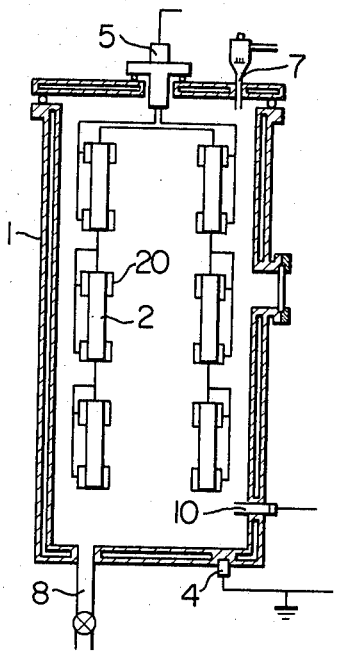
FIG. 7 is a schematic diagram of another embodiment of the surface treatment apparatus carried out in accordance with a surface treatment process of the present invention which is applied as a carbonitriding process in glow-discharge plasma.
Figure 8:
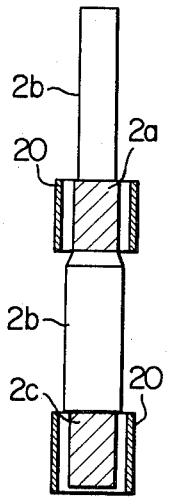
FIG. 8 is an enlarged view of the metallic material to be treated and the secondary electrodes, used in the surface treatment apparatus in FIG. 7.

Workpieces 2 as shown in FIG. 7 was placed in the surface treatment apparatus of FIG. 1 which was modified for the carbonitriding process. In this test, heavily hardening treatment was required for the portions 2*a* and 2*c* of the workpiece, which are surrounded by secondary electrodes 20 at the portions 2*a* and 2*c*, as shown in FIG. 8.

As the workpiece 2, a shaft of SCM451 chromium-molybdenum steel (JIS) (15–20 mm in diameter and 205 mm in length) was used. As shown in FIG. 8, the portions necessary for heavily hardening are placed at the middle portion (25 mm long) of the shaft and at the portion (25 mm long) from one end thereof. The other portion of the shaft is applied with usual carbonitriding treatment (diffusion depth is on the order of 0.05 mm). The secondary electrode 20 was made of SUS304 (JIS) and spaced 3 mm from the shaft.

Figure 9:
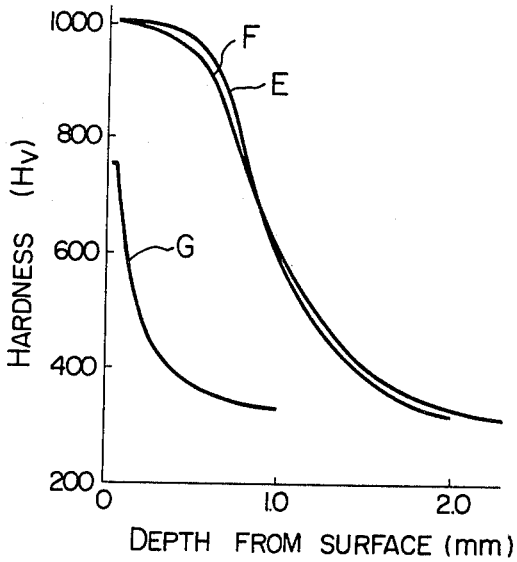
FIG. 9 is a graphical representation showing the relationship between the hardness on the surface of the workpiece obtained from the apparatus in FIG. 8 and the depth below the workpiece surface.

In the carbonitriding process, firstly, the pressure in the vacuum container 1 was decreased below $10^{-2}$ Torr and then nitrogen, hydrogen, methane and argon gas were fed into the container so as to keep the container pressure at 1 Torr. A dc voltage between 400–1000 V was applied so that glow discharge occurs and the shaft is carbonitrided at 600° C. for 4.5 hours. Under this condition, the temperature of the portions surrounded by the secondary electrodes was much the same as that of the other of the shaft. Subsequently, the gas pressure was raised to about 4 Torr and additional treatment was performed on the shaft for additional 30 minutes with exhausting the methane gas. In this case, the portions surrounded by the secondary electrodes were heated to 900° C. and the other of the shaft was heated to 600° C. (set temperature). Thereafter, the shaft was quenched and the hardness below the surface thereof was measured. The results are given in FIG. 9 in which curves E and F indicate the hardness of the portions surrounded by the secondary electrodes and curve G indicates that of the other of the shaft. It will be readily noticed from FIG. 9 that the hardness of the portions 2*a* and 2*c* heated by varying the gas pressure according to the process of the present invention, that is, curves E and F has at least Hv 513 from the surface of the portions of a depth of 1.1–1.2 mm thereof; whereas, hardness of the other of the shaft, that is, curve G has much the same hardness in the range of 0 (surface)-0.2 mm depth thereof. More specifically, since the portions 2*a* and 2*c* surrounded by the secondary electrodes were heated to 900° C. (which is in the region of austenite of steel), carbon atoms were deeply diffused into the portions to form a heavily carburized layer. In other words, curves E and F indicate the relationship between the concentration of the carbon atoms diffused below the surfaces of the portions, and the depth below the surfaces. On the other hand, since the other portion of the shaft was heated to a lower temperature of 600° C. (which is in the region of ferrite of steel), solid solution limits of nitrogen and carbon are low and thus the diffusion rate is low, resulting in a shallow carbonitrided layer.

In this way, according to the process of the present invention, workpieces of metallic material can be treated so that at different portions thereof, different treatments are continuously accomplished to give different surface properties or functions in the container, allowing the remarkable saving of the energy necessary for heating.

EMBODIMENT 4

In the embodiment, the present invention will be explained in the case where the portion of a workpiece is heated to a higher temperature to form a heavily carbonitrided layer, and further the portion thereof is quenched for additional hardening.

Figure 10:
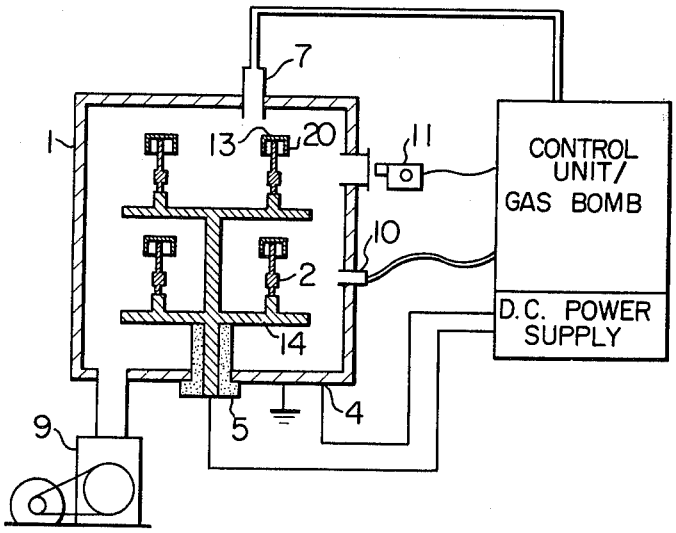
FIG. 10 is a schematic diagram of a further embodiment of the surface treatment apparatus carried out in accordance with the surface treatment process of the present invention which is applied as an ion carbonitriding process.
Figure 11:
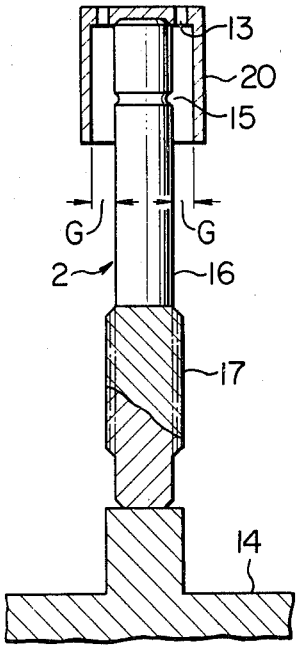
FIG. 11 is an enlarged diagram showing how the workpieces are mounted in the apparatus of FIG. 10 used for the carbonitriding wherein only one workpiece is illustrated for clarity.

There is shown in FIG. 10 and FIG. 11 a surface treatment apparatus which is carried out according to the carbonitriding process of the present invention, said apparatus includes a gas opening 13 provided on a secondary electrode 20, a structure 14 for supporting a cathode terminal 5, a stopper portion 15 on the workpiece 2 which comprises a starter shaft, in this embodiment, a shaft portion on the starter shaft 2, and a spline portion 17 on the starter shaft 2.

Figure 12:
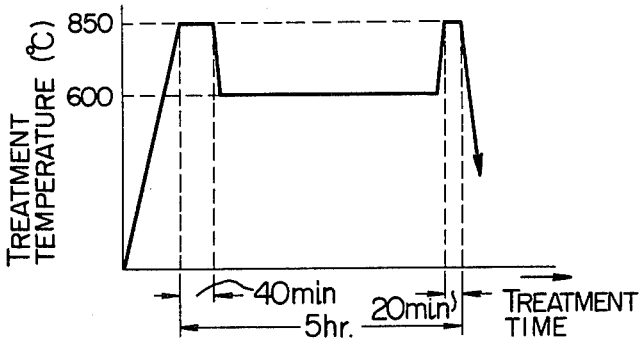
FIG. 12 is a graphical representation showing the relationship between the treatment time and the treatment temperature in the ion carbonitriding process of FIG. 10.

In FIG. 10, the starter shaft 2 was placed in a container 1, air in the container 1 was drawn up to below $10^{-2}$ Torr and the treatment gas was introduced into the container 1 so as to keep the atmosphere or gas pressure in the container at 5 Torr. The treatment gas consists of nitrogen (50%), methane (3%) and hydrogen (the remainder). Then, a dc voltage between 300–1,500 V was applied so as to take place glow discharge. The processing sequence or pattern followed FIG. 12, that is, during the first 40 minutes and the last 20 minutes out of the carbonitriding treatment of 5 hours at 850° C. and 600° C., the gas pressure was lowered from 5 Torr to 3 Torr. Reduction of the gas pressure provided a glow discharge of mutual interference effect between the stopper portion 15 of the starter shaft 2 and the secondary electrode 20, thereby heating the stopper portion to about 850° C. of a substantial carburizing temperature. However, even if the stopper portion 15 was heated to about 850° C., the other portions of the starter shaft 2, i.e., the spline portion 17 and the shaft portion 16 were about 600° C. and thus were carbonitrided. The treatment temperature and the gas pressure were controlled and measured by means of control panel.

Figure 13:
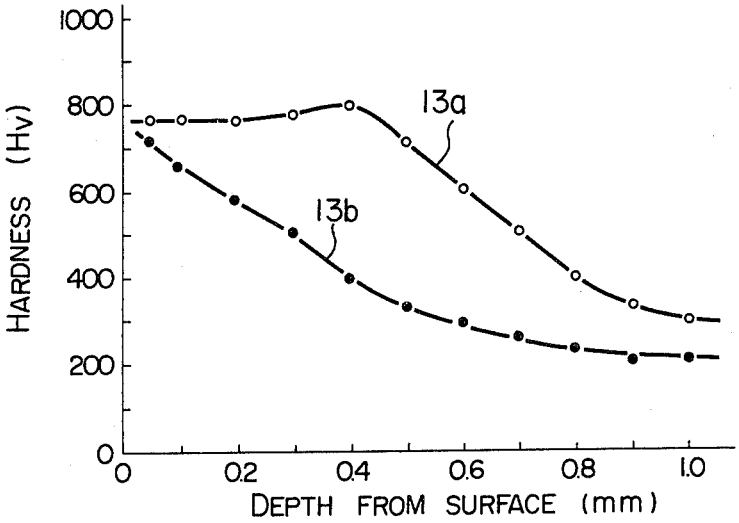
FIG. 13 is a graphical representation the hardness of the surface of the workpiece obtained from the apparatus of FIG. 10, and the hardness on the workpiece surface.

After completing the above carbonitriding process, the stopper portion 15 was subjected to an induction (230 kHz) heat treatment to 930° C. (maximum) and then was quenched with water. Thereafter, the starter shaft was tempered or annealed for one hour at 180° C. The hardness of the starter shaft so obtained is shown in FIG. 13 in which curve 13*a* indicates the hardness of the stopper portion thereof and curve 13*b* indicates that of the shaft portion. After the stopper portion has been carburized and quenched, the effective depth 0.7 mm was obtained for the hardened layer thereof and the effective depth 0.3 mm was obtained for the carbonitrided portion other than the stopper portion.

Figure 14A:
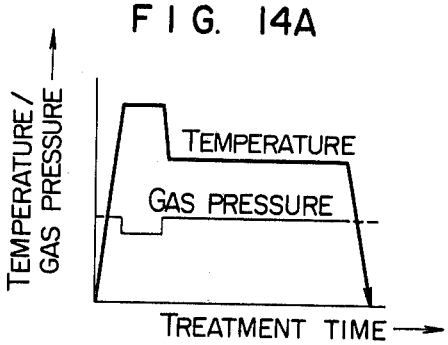
FIGS. 14A to 14E show graphical representations each showing the relationship of the treatment time versus the treatment temperature and gas pressure.
Figure 14B:
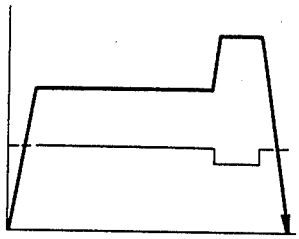
Figure 14C:
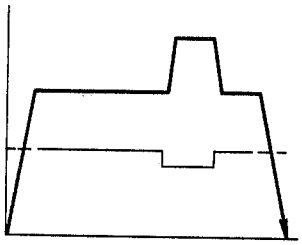
Figure 14D:
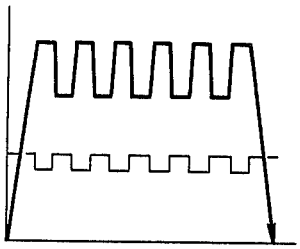
Figure 14E:
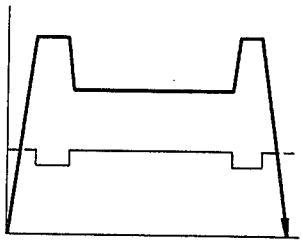

FIGS. 14A to 14E show when and how long the selected portion of the starter shaft is locally heated to provide a carbonitriding treatment (but substantially carburizing) of high carbon concentration, in the total processing time of the carbonitriding process. In FIG. 14A, carburizing is performed at the beginning of the carbonitriding process period. In the treatment of FIG. 14A, the desired surface hardness of the resultant hardened portion is sometimes insufficient since the subsequent carbonitriding step causes a deeper movement of the carbon atoms already diffused at the vicinity of the surface of the portion during the first treatment step so as to lower the carbon concentration at the vicinity of the surface. FIG. 14B shows an example where carburizing is provided at the last period of the carbonitriding process. With the treatment of FIG. 14B, the carbon concentration becomes excessively high at the vicinity of the surface of the hardening portion and thus induction quenching sometimes provides undesirably excessive carbon concentration in the portion (contrary to the case of FIG. 14A). In FIG. 14C, carburizing is provided at the latter portion or stage of the carbonitriding process, followed by a suitable carbon-diffusing period. FIG. 14D shows an example where carburizing is intermittently performed on a pulse basis of a selected period among the carbonitriding process. FIG. 14E shows an example where carburizing is provided at the beginning and the end of the carbonitriding process. In order to make uniform the carbon concentration from the surface to the interior of the selected portion of a workpiece as possible, it is preferable to use one of the treatment patterns of FIGS. 14C to 14E.

The tempering temperature after induction quenching is desirable to be in the range of 130°–300° C. This will cause a breakdown of the residual austenite due to the induction quenching, with a desirable hardness distribution.

Local or partial surface quenching of the carbonitrided layer of high carbon concentration formed by the carbonitriding process may be accomplished by a suitable laser means or by placing it in a suitable cooling agent after the treatment, in place of the induction quenching.

EMBODIMENT 5

In the ion carburizing surface treatment with the use of secondary electrodes, treatment temperature, treatment time and the distribution of carbon concentration below the surface of a workpiece metal are important factors. More specifically, in the ion carburizing process of treating workpieces with the secondary electrode, the selected portion of the workpiece can be easily carburized to form a deep carburized layer for only a short time. However, the heating of the selected portion at a high temperature for a long time will cause enlargement of crystalline size and deteriorate the mechanical property. The same holds true for a prior art process, e.g., a gas carburizing process. However, when the workpiece has an excessive carbon potential, the carburized portion becomes abnormal structure in which cementite is precipitated like a while network state, resulting in the formation of a brittle carburized layer.

Since excessive carburizing results from excessive supply of carbon atoms, high temperature treatment which increases ability of solid solution of carbon, and subsequent quenching leading to decrease of the solid solution so as to precipitate carbon on grain boundary, the workpiece having normal surface property or hardness can be produced by changing gas composition to reduce carbon component and controlling carburizing and subsequent diffusion temperature.

An effective carburizing process to a steel comprises steps of carburizing at a high temperature (above 900° C.) at which the solid solubility of carbon to steel is large, and then diffusing carbon inside the steel uniformly. For this purpose, a high temperature short time carburizing and subsequent diffusion process below 900° C. are desirable, thereby preventing coarsening which leads to fragility. However, according to a prior art gas carburizing process with a heating means such as a heater and flame of a combustible gas, since it is difficult to quickly attain a predetermined high temperature and accurately maintain that temperature for a short time, the prior art process is such that a relatively long time treatment is carried out at about 900° C. at which coarsening of crystal grain does not occur.

In a surface treatment process wherein secondary electrodes are used to cause discharge on the hollow cathode effect, according to an embodiment of the present invention, the gas pressure is varied to accurately control the amount of the carbon atoms supplied into the container, whereby attaining high temperature carburizing process with accurately controlling the amount of carbon diffused into the desired portion of a workpiece, thus eliminating the above defects in a prior art process.

Figure 6:
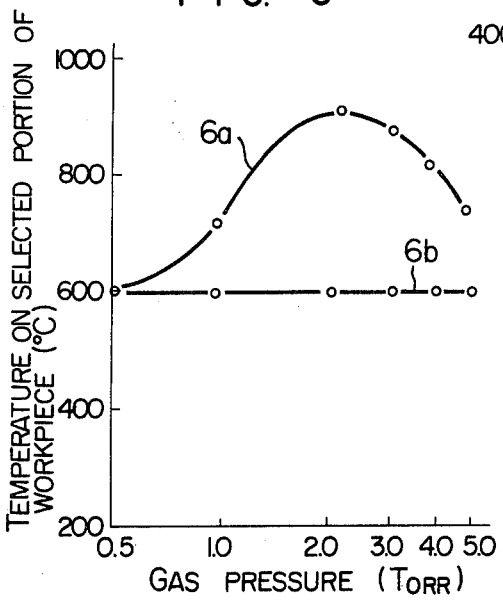
FIG. 6 is a graphical representation showing the relationship between the gas pressure and the temperature on the selected portion of the workpiece covered with the secondary electrode, with and without the hollow cathode effect.
Figure 15:
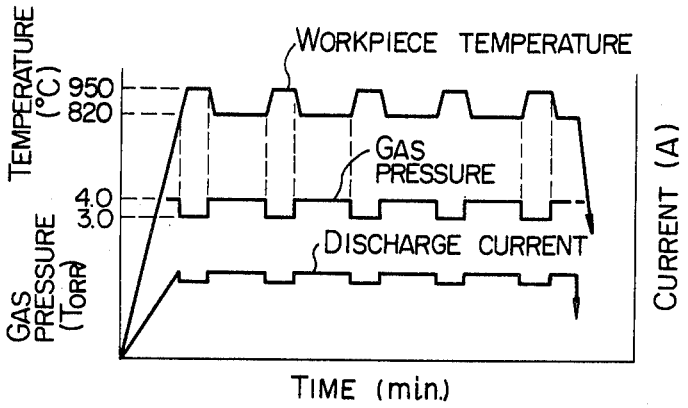
FIG. 15 is a graphical representation showing the relationship of the treatment time versus the treatment temperature, gas pressure and discharge current, in the case of the carburizing process in a glow discharge.

In order to provide carburizing to the selected two portions of a cold-rolled starter shaft of SCM415 (JIS) to form hardened portions thereto on the basis of principle of FIG. 6, the starter shaft was placed together with the associated secondary electrode in the vacuum container, with the workpiece of the starter shaft and the secondary electrode being connected to the cathode terminal and the wall of the container connected to the anode terminal, as shown in FIG. 7. Carburizing and diffusion were alternately provided to the starter shaft, according to the treatment sequence of FIG. 15. The secondary electrode was of cylinder and was made of graphite, and the spacing of 6 mm was provided between the starter shaft and the associated secondary electrode. The gas pressure was kept at 3 Torr during carburizing and at 4 Torr during diffusion. Carburizing and diffusion operations were each performed 5 times alternately. The time of one carburizing operation was set to 3 minutes and the total time thereof was set to 60 minutes. The shaft thus carburized was cooled in the container, and was hardened by means of the induction heating followed by quenching. The obtained shaft was cut off at its carburized portion and the cross section of the cut portion was abraded or polished. The structure of the section at the vicinity of its surface was observed.

Figure 16:
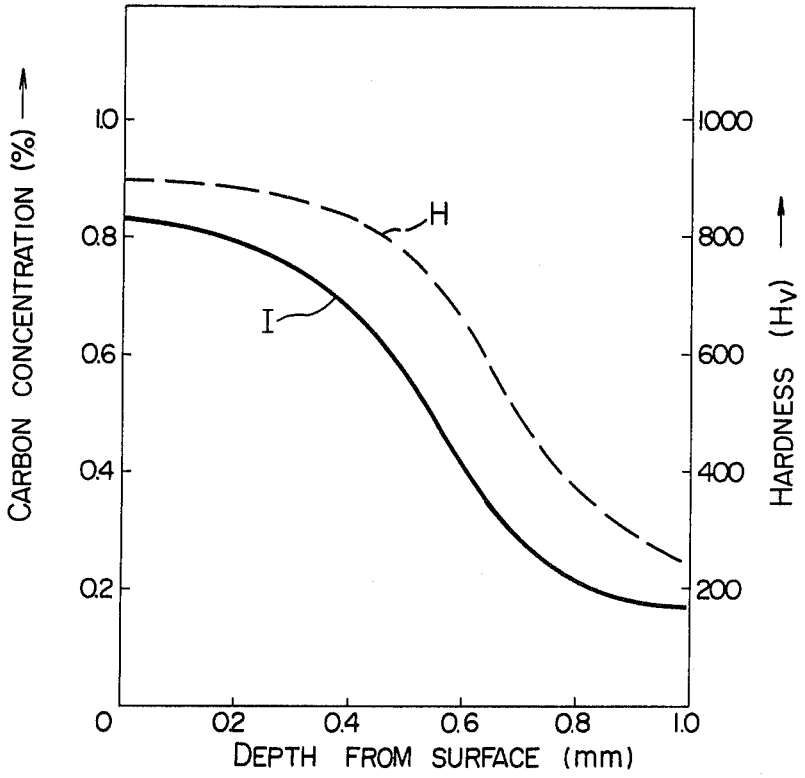
FIG. 16 is a graphical representation showing the relationship between the hardness and carbon concentration on the surface of the workpiece obtained from the carburizing process of FIG. 15.

Further, the cut section of the shaft was measured with respect to the hardness distribution below the surface thereof with the use of a micro Vickers tester and with respect to the distribution of carbon concentration below the surface thereof with the use of an E.P.M.A. As the result, the carburized layer, that is, the selected portion of the shaft was of all martensite structure and any excess carburizing or decarburized layer was not observed. The test results are given in FIG. 16. In FIG. 16, a solid line I is the carbon concentration and a broken line H is the hardness. It will be obvious from FIG. 16 that the carbon concentration is 0.83% at the surface and that diffused layer reaches 0.8 mm deep. The induction quenching or hardening step provides a surface hardness of Hv 900, and the effective depth of the hardened layer (Hv>550) is 0.65 mm.

As has been described in the foregoing, the iron treatment process of the present invention is very useful, especially such as a quick carburizing process in which a workpiece is treated at a high temperature. It goes without saying that the present invention can be applied to a wide range of treatment including a carbonitriding process and a nitriding process wherein workpieces are treated in glow discharge plasma. Further, the high-frequency hardening step may be carried out by suitable laser means or by putting the workpiece in suitable cooling agent.

EMBODIMENT 6

A surface treatment process in which a plurality of kinds of treatments are continuously made to produce a workpiece having a plurality of surface portions having different properties or serving for different functions or purposes. According to this process, a portion of the workpiece is subject to the carbonitriding process to form a high carbon concentration deeply hardened layer, another portion is subject to the carbonitriding process to form a shallow carbonitriding layer and still another portion is also subject to a sulfur-nitriding process.

Figure 17:
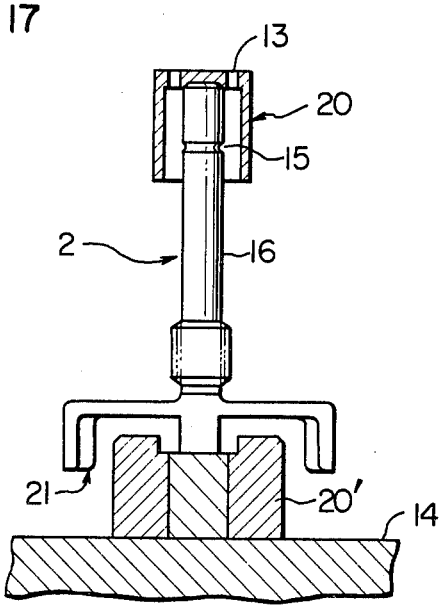
FIG. 17 shows another embodiment of the present invention, in which the workpiece is to be treated in the apparatus of FIG. 10.
Figure 18:
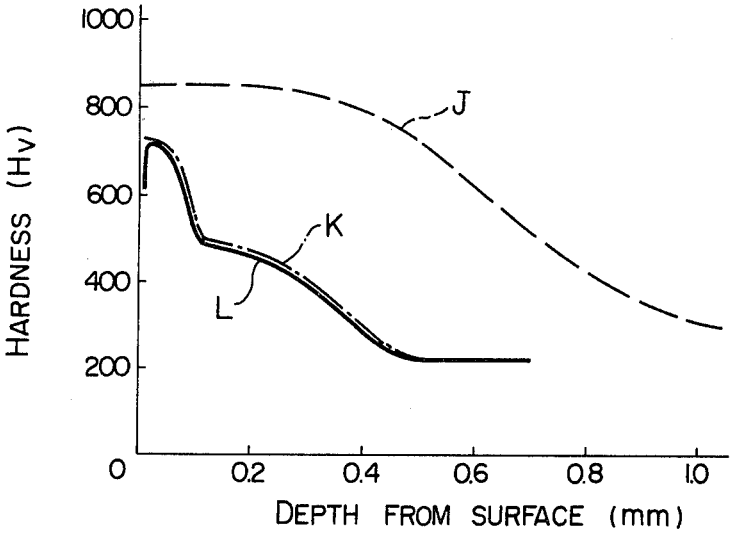
FIG. 18 is a graphical representation showing hardness distribution of a plurality of surface portions of the workpiece treated in the embodiment of FIG. 17.

The workpiece 2 is a cold-forged gear shaft of SCM451 (JIS), as shown in FIG. 17. In the figure, a stopper portion 15 must have a deep hardened layer since it is subject to a blow abrasion. An inner gear portion 21 and a shaft portion 16 are treated below 600° C. to form carbonitriding layers thereon to improve abrasiveness and fatigue strength, without losing the strength given by the cold-forge. Furthermore, at a final step in the process, the inner gear portion 21 is subject to the sulfur-nitriding treatment to provide a fitting characteristic required at an early stage of friction, and the abrasiveness. The workpieces are disposed in the container such as shown in FIG. 10 together with the secondary electrodes 20 and 20' of particular configuration, as shown in FIG. 17. The workpieces and the secondary electrodes are connected to the cathode and the container wall is connected to the anode. In an atmosphere having gas composition for the carbonitriding, the discharge based on the hollow cathode effect is caused at the portion 15 maintaining 850° C. for 40 minutes. Then, the gas pressure is changed to cause the glow discharge to heat that portion at 600° C. for 3 hours. Nextly, by changing the gas pressure, the discharge based on the hollow cathode effect is established maintaining 850° C. for 20 minutes, and finally condition of below 400° C. is held for 15 minutes. This is a full cycle. A cycle for the portion 16 consists of conditions of 600° C. for 4 hours and below 400° C. for 15 minutes. While, the inner gear portion 21 after the carbonitriding process at 600° C. for 4 hours, is subject to the discharge based on the hollow cathode effect in a changed atmosphere of nitriding gas composition added with 0.5% $H_2S$, to carry out the sulfur-nitriding treatment only on the portion 21, at 600° C. for 15 minutes. Thereafter, the workpiece is cooled in the furnace container 1. Then, the portion 15 is subject to the surface induction quenching. During a time which the portion 15 is subject to the discharge based on the hollow cathode effect, the portions 16 and 21 are subject to the ordinary glow discharge maintaining 600° C. Furthermore, during the time which the portion 21 is subject to the discharge to form the sulfur-nitriding layer, the portions 15 and 16 are under the weak glow discharge below 400° C. Thus, no sulfur-nitriding layer is formed on the portions 15 and 16. The above mentioned 4 hour and 15 minutes complete treatment process provides a plurality of surface treatments serving for different functions. FIG. 18 shows hardness distributions on surface of the workpiece after the treatment, in which J. K and L correspond to the portions 15, 16 and 21, respectively. The portion 15 has a hardened layer of high carbon concentration provided by mainly the carburizing, with a surface hardness of 850 Hv and an effective hardened layer of 0.65 mm in depth. Since the portion 16 was treated at a low temperature compared with the portion 15, the carbonitrided layer containing nitrogen and carbon is formed, with the surface hardness of Hv 750 and the effective hardened layer of 0.1 mm in depth which is shallower than the hardened layer of the portion 15. Since the portion 21 comprises a carbonitrided layer and a shallow sulfur-nitrided layer of a low hardness on the carbonitrided layer, the surface of the portion 21 is relatively weak compared with the surface of the portion 16. The hardness of the inside of the portion 21 is substantially the same as that of the portion 16.

As described above, by a single treatment process, a plurality of surface layer can be provided which serve for different functions.

EMBODIMENT 7

Figure 19:
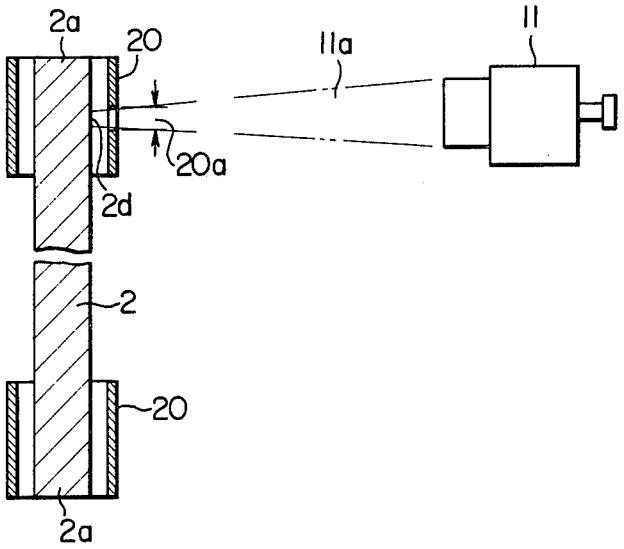
FIG. 19 is a schematic diagram explaining how a temperature on a portion of a workpiece which is covered with the secondary electrode is measured.

As shown in FIG. 6, the temperature rise of the desired portions of a workpiece due to the hollow cathode effect surrounded by the associated secondary electrodes will depend on the gas pressure in the container. The proper heating temperature of the desired portions differs depending on the material of the workpiece. For example, in the case that steel is used as the workpiece, the proper heating temperature is 400°-700° C. in a nitriding process, 700°-1100° C. in a carburizing process, 800°-1200° C. in a boron treatment process, and 150°-600° C. in a nitriding process. In this way, in order to provide proper treatment on the workpiece, the treatment temperature must be selected according to the process and the material of workpieces to be used. In this embodiment, the present invention is arranged so that the temperature on the selected portions of the workpiece surrounded by the associated secondary electrode is detected and according to the detected temperature, the gas pressure is accurately controlled for accurate surface treatment. In this connection, the secondary electrode which surrounds the selected portion **2*d* of the workpiece 2, is provided with an opening 20*a*, as shown in FIG. 19. The opening 20*a* is of 2 mm-25 mm in diameter and aligned with an optical pyrometer (infrared-radiation type temperature measuring device) 11. Therefore, infrared radiation emitted from the selected portion 2*d* (the temperature of which is to be measured) is directed through the opening provided in the secondary electrode 20 to the optical pyrometer to detect the temperature on the selected portion. When the opening is of 2 mm or smaller diameter, the temperature on the surface of the selected portion 2*d* detected by the optical pyrometer 11 becomes low because it is interferred with the temperature of the secondary electrode 20. If the opening is of 25 mm or larger diameter, on the other hand, good heating effect by the discharge on the hollow cathode effect can not be provided, so that the selected portion 2*d* has an irregular temperature distribution, resulting in an undesirable treatment. For this reason, the diameter of the opening 20*a* is in the range of 2 mm-25 mm, preferably 3 mm-10 mm, although it varies depending on the size of the associated secondary electrode 20**.

Further, the opening may be of any shape such as ellipse, circle, square, rectangle, trapezoid, rhombus and polygon, as long as it will not block the passage of infrared radiation through the opening. In order to provide an uniform heating of hollow cathode discharge, however, it is desirable to be circular because of its easy machining.

In this embodiment, a workpiece 2 was placed in the glow-discharge treatment apparatus of FIG. 1 or FIG. 7, together with the secondary electrode 20 shown in FIG. 19, in order to deeply carburize only the selected portion **2*a*** of the workpiece.

As the workpiece 2, a shaft was used of SCM21 chromium-molybdenum steel (JIS), of 15-20 mm diameter and 205 mm length. As shown in FIG. 19, the portion **2*a* necessary to deeply be carburized and hardened has a 25 mm width from one end of the shaft, and the other thereof is unnecessary to harden. The secondary electrode 20 of FIG. 19 was disposed around the portion 2*a*. The spacing between the portion 2*a* and the secondary electrode 20 was set to 3 mm. The secondary electrode 20 in FIG. 17** was made of SUS304 (JIS) was provided with a 7 mm diameter opening for passage of infrared radiation to the associated optical pyrometer.

Figure 20:
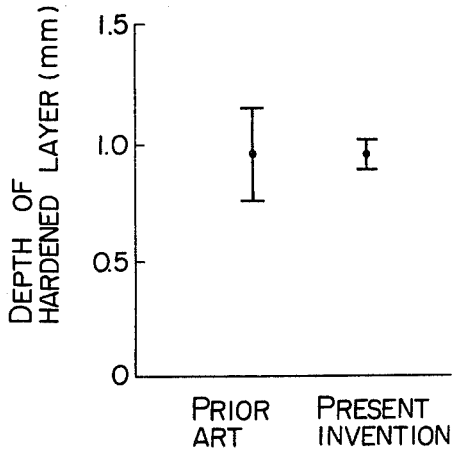
FIG. 20 is a graphic representation in which the depth of the hardened layer according to the present invention is compared with that according to a prior art process.

In operation, the pressure in the vacuum container 1 was reduced to $10^{-2}$ Torr or less, and then hydrogen, methane and argon gas were fed into the container so as to maintain the container pressure at 4 Torr. A dc voltage between 400-600 V was applied to cause glow discharge to heat the shaft for 30 minutes. Under this condition, the temperature on the selected portion **2*d* was set to 900° through the optical pyrometer. After the treatment, the shaft 2 was quenched, cut across the selected portion 2*a*, and the cut section was measured with respect to the hardness distribution. FIG. 20 shows a comparison of average depth variations in the hardened layers between the process of the present invention and a prior art process. It will be obvious from FIG. 20** that the hardened layers of the selected portions of workpieces obtained from this embodiment are all in the range of 0.95 mm±0.07 mm depth since the treatment temperature was controlled through the optical pyrometer; whereas, in the prior art process, since it is impossible to measure accurately the temperature on the selected portion at which the discharge based on the hollow cathode effect is caused, the workpieces are subject to variation of the treatment temperature and thus the obtained hardened layers are all in the range of 0.95 mm±0.2 mm depth. As a result, the present invention has an advantage over the prior art that the obtained hardened layers are uniform in depth because it allows an accurate measurement of the treatment temperature.

In order to measure the treatment temperature on the desired portion of a workpiece, there is one prior art process which uses as a temperature measuring means a dummy of the same configuration and size as the workpiece. According to another prior art process, a temperature measurement is made at the vicinity of the selected portion of the workpiece where the hollow cathode effect is predominant. However, since a measurement of the treatment temperature is conducted indirectly in these prior art processes, it is impossible to measure accurately the treatment temperature, unlike the present invention.

Explanation has been made in the foregoing about how the treatment process based on hollow cathode effect is carried out according to the present invention. The treatment apparatus of the present invention may be used as a workpiece heating furnace, when inert gas such as Ar, He, and $H_2$ or other gas that will not act with the material of the workpiece to provide for example hardening action, is used as the discharge gas. According to a hollow cathode method of the present invention, provision of a secondary electrode near the desired portion of a workpiece can allow the heating of the desired portion thereof at a desired temperature under control of the gas pressure. In this case, since the heating is provided directly, it is also possible to heat or cool the desired surface alone of a workpiece quickly. In addition, the present invention has an advantage that adding a proper amount of hydrogen gas and the like to Ar or He gas as its discharge gas will eliminate such problems as the oxidation or decarburization reaction of the workpieces with the atmosphere gas which often occurs in a prior art process.

Furthermore, it is possible to form the secondary electrode such that it has the hollow-cathode effect by itself. In this case, the secondary electrode may be used as a pre-heating means for effectively preparing for the subsequent heat treatment.

What we claim is:

1. A surface treatment process wherein glow discharge is established between a cathode and an anode of a power source to carry out heat treatment of a workpiece under a reduced pressure condition in a container, comprising the steps of placing the workpiece which has a conductive surface and which is electrically connected to the cathode in said container, positioning a secondary electrode which has a conductive surface and which is electrically connected to the cathode close to a selected treatment portion of said workpiece, and effecting a glow discharge between the conductive surfaces of said workpiece and the secondary electrode and said anode; the distance between the workpiece and the secondary electrode being set to be 2 to 25 mm to increase the surface temperature of the selected treatment portion of said workpiece and to increase the heat treatment effect on said selected treatment portion of said workpiece and the pressure of the treatment atmosphere being varied in the range 0.1 to 10 Torr to control the treatment temperature.

2. A surface treatment process as defined in claim 1 wherein the workpiece is treated in a treatment atmosphere of a single gas or a mixture thereof selected from the group consisting of nitrogen, hydrocarbons, ammonia, hydrogen sulfide, volatile boron compounds, hydrogen, argon and helium gas.

3. A surface treatment process as defined in claim 2 wherein the pressure of the treatment atmosphere is varied in a predetermined range to control the treatment temperature.

4. A surface treatment process as defined in claim 2 wherein after the selected portion of a workpiece is heated to a desired treatment temperature, the selected portion is quenched.

5. A surface treatment process as defined in claim 4 wherein a temperature of the selected portion of the workpiece in glow discharge plasma is measured and according to the measured temperature, the pressure of the treatment atmosphere is varied.

6. A surface treatment process as defined in claim 4 wherein the pressure of the treatment atmosphere is varied within a predetermined range plural times on a repetitive basis.

7. A surface treatment process as defined in claim 2 wherein the selected portion of the workpiece and the other portion thereof are set to be 400° C. or higher and 350° C. or lower, respectively.

8. A surface treatment process as defined in claim 2 wherein the treatment atmosphere includes at least two diffusion atoms which contribute to the treatment, and the selected portion of the workpiece adjacent to the secondary electrode and the other portion thereof are subjected to different surface treatments.

9. A surface treatment process as defined in claim 2 or 4 wherein the selected portion of the workpiece adjacent to the secondary electrode is deeply carbonitrided and carburized to form a carbonitrided layer and a carburized layer where the carbon concentration is higher than that of other portions.

10. A surface treatment process as defined in claim 2 or 4 wherein the selected portion of the workpiece adjacent to the secondary electrode is deeply carbonitrided to form a carbonitrided layer where the carbon concentration is higher than that of other portions.

11. A surface treatment process as defined in claim 10 wherein a heavily carbonitrided layer or a heavily carburized layer with a high carbon concentration is formed in the selected portion of the workpiece at the beginning and the end of the entire treatment time during which a carbonitriding or a carburizing treatment is carried out for the other portion thereof.

12. A surface treatment process as defined in claim 10 wherein a heavily carbonitrided layer or a heavily carburized layer or a heavily carburized layer with a high carbon concentration is formed in the selected portion of the workpiece near the end of the entire treatment time during which a carbonitriding or a carburizing treatment is carried out for the other portion thereof.

13. A surface treatment process as defined in claim 10 wherein a heavily carbonitrided layer or a heavily carburized layer with a high carbon concentration is formed, on an intermittent basis, in the selected portion of the workpiece within the entire treatment time during which a carbonitriding or carburizing treatment is carried out for the other portion thereof.

14. A surface treatment process as defined in claim 4 wherein hardening is carried out with induction heating followed by quenching.

15. A surface treatment process as defined in claim 4 wherein hardening is carried out with a laser heating or electron base bombardment.

16. A surface treatment process as defined in claim 2 or 4 wherein at the selected portion of the workpiece adjacent to the secondary electrode is formed a deeply carburized layer of high carbon concentration.

17. A surface treatment process as defined in claim 5 wherein supply and exhaust of the treatment atmosphere are controlled according to the detected temperature, on a feedback basis.

18. A surface treatment process as defined in claim 2 or 4, wherein concentration of a diffusing substance is controlled to be decreased as the treatment temperature increases.

19. A surface treatment process as defined in claim 1, wherein said container contains a gaseous atmosphere including a carbon source.

20. A surface treatment process as defined in claim 1, wherein said secondary electrode has a surface area that is at least equal to the surface area of the selected treatment portion of said workpiece and the secondary electrode is arranged so that the surface area of the secondary electrode facing the workpiece is equidistance from said workpiece.

* * * * *